US005249991A

United States Patent [19]

Schinkel

[11] Patent Number: 5,249,991

[45] Date of Patent: Oct. 5, 1993

[54] MANUALLY OPERATED PROPULSION DEVICE FOR A CANOE

[76] Inventor: William J. Schinkel, P.O. Box 723, Fredric, Wis. 54837

[21] Appl. No.: 956,333

[22] Filed: Oct. 5, 1992

[51] Int. Cl.[5] ..... B63H 16/20

[52] U.S. Cl. ..... 440/27

[58] Field of Search ..... 440/21, 24–31, 440/90, 91, 104, 105; 114/347

[56] References Cited

U.S. PATENT DOCUMENTS 1,024,419 4/1912 Resch ..... 440/31

1,532,990 4/1925 Csengery ..... 440/27

*Primary Examiner*—Jesus D. Sotelo

*Attorney, Agent, or Firm*—Michael I. Kroll

[57] ABSTRACT

A manually operated propulsion device is provided for a canoe having a hull with a pair of gunwales, a seat extending directly under the gunwales for a person to operate the device and a thwart spaced away from the seat, extending directly under the gunwales. The device is two propelling mechanisms, in which each propelling mechanism consists of a structure for rotatively securing a drive shaft between the seat and the thwart of the canoe, so that the drive shaft will extend transversely over one of the gunwales of the canoe. A paddle assembly is transversely connected to an outer end of the drive shaft. An apparatus is for manually rotating an inner end of the drive shaft by the person sitting on the seat in the canoe, so that the paddle assembly will contact water thereabout to propel and steer the canoe through the water.

14 Claims, 2 Drawing Sheets

MANUALLY OPERATED PROPULSION DEVICE FOR A CANOE

BACKGROUND OF THE INVENTION

1. Field of the Invention

The instant invention relates generally to boats and more specifically it relates to a manually operated propulsion device for a canoe.

2. Description of the Prior Art

Numerous boats have been provided in prior art that are adapted to contain various types of mechanisms which propel the boats through bodies of water. For example, U.S. Pat. Nos. 1,024,419 to Resch; 1,495,002 to Delgado; 1,527,571 to Morrison; 1,532,990 to Csengery; 2,505,721 to Peter et al; 2,578,535 to Graci; 3,779,202 to Martin et al and 4,979,916 to LeBlanc all are illustrative of such prior art. While these units may be suitable for the particular purpose to which they address, they would not be as suitable for the purposes of the present invention as heretofore described.

SUMMARY OF THE INVENTION

A primary object of the present invention is to provide a manually operated propulsion device for a canoe that will overcome the shortcomings of the prior art devices.

Another object is to provide a manually operated propulsion device for a canoe that can be propelled and steered by one person efficiently, without strain and effort by the person.

An additional object is to provide a manually operated propulsion device for a canoe in which the paddle assemblies can be adjusted, so that the depth of submergence of the paddles may be regulated for the need of the person using the canoe.

A further object is to provide a manually operated propulsion device for a canoe that is simple and easy to use.

A still further object is to provide a manually operated propulsion device for a canoe that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
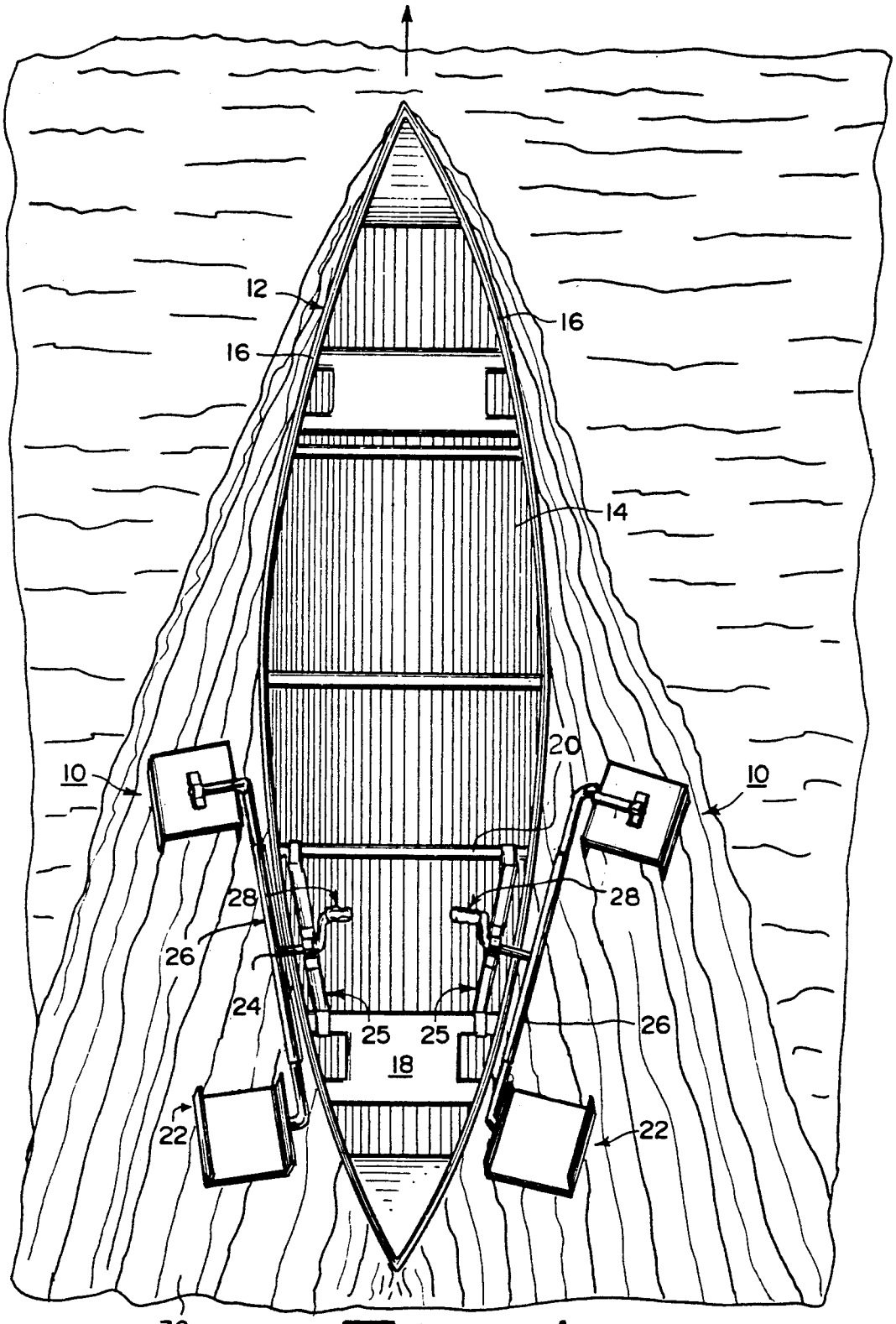
FIG. 1 is a top plan view of a canoe with the instant invention installed therein.
Figure 2:
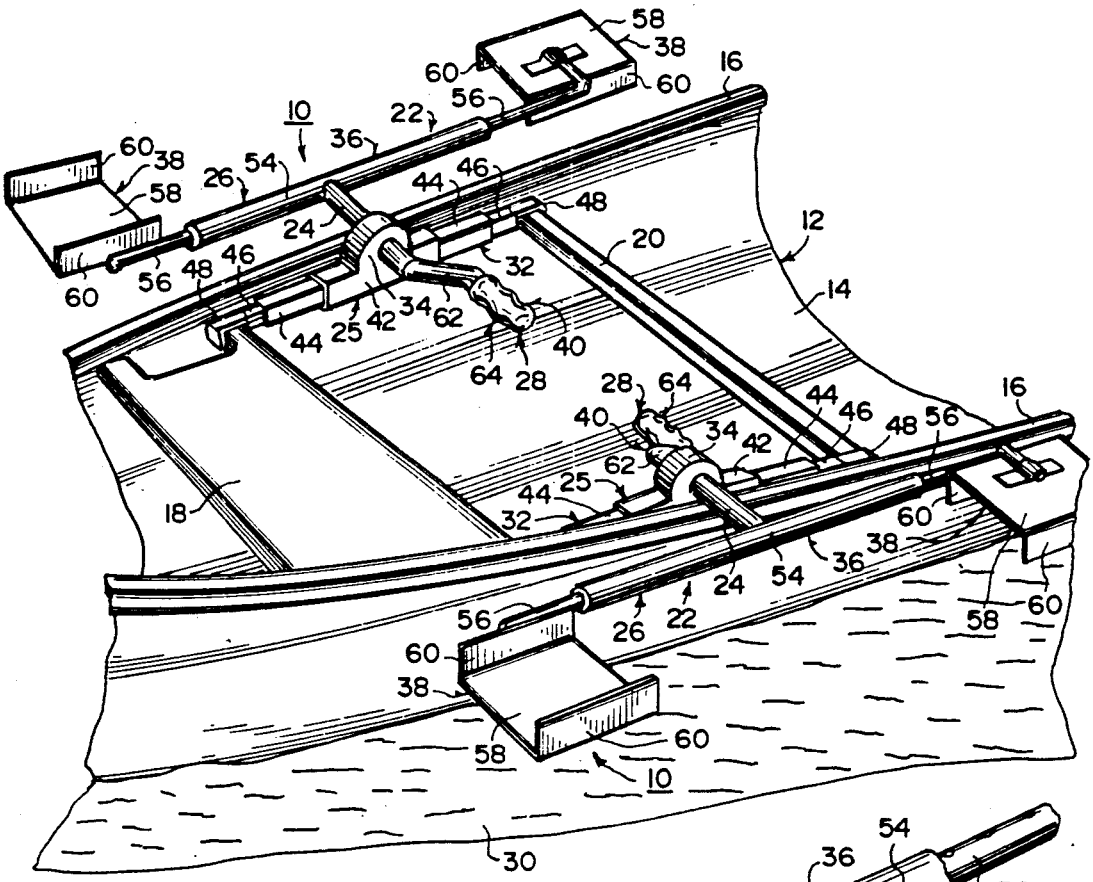
FIG. 2 is a perspective view of a portion of the canoe showing the instant invention in greater detail.
Figure 3:
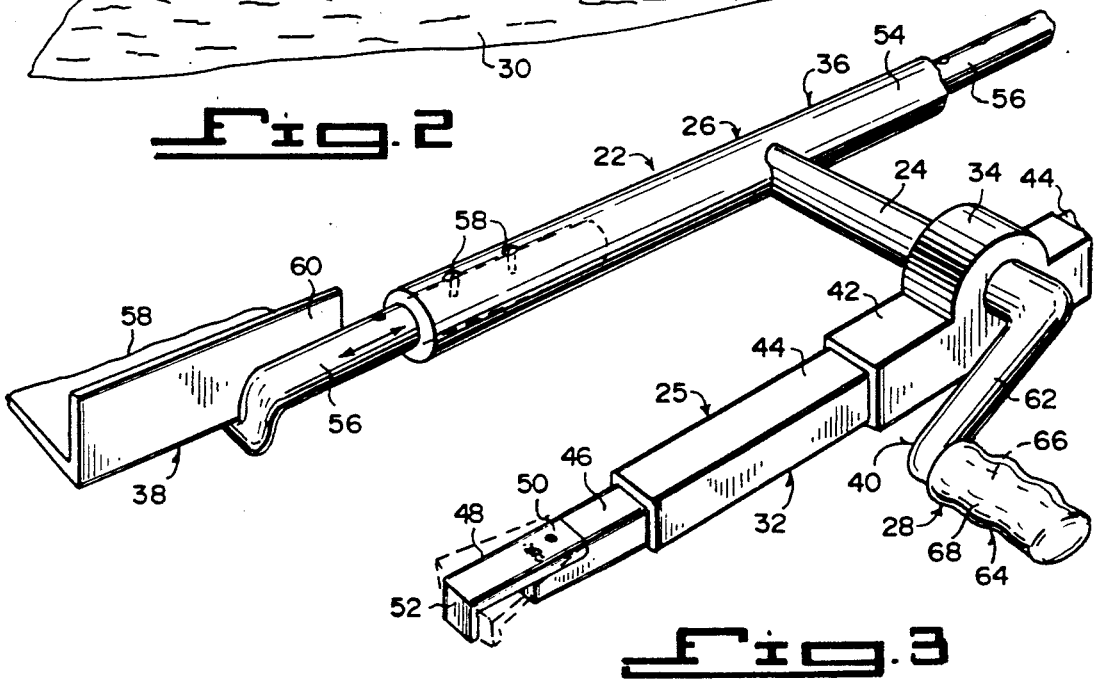
FIG. 3 is an enlarged perspective view with parts broken away of one of the propelling mechanism of the instant invention.

Turning now descriptively to the drawings, in which similar reference characters denote similar elements throughout the several views, the Figures illustrate a manually operated propulsion device 10 for a canoe 12 having a hull 14 with a pair of gunwales 16, a seat 18 extending directly under the gunwales 16 for a person to operate the device 10 and a thwart 20 spaced away from the seat 18, extending directly under the gunwales 16. The device 10 is two propelling mechanism 22 in which each propelling mechanism 22 comprises a drive shaft 24, with a structure 25 for rotatively securing the drive shaft 24 between the seat 18 and the thwart 20 of the canoe 12, so that the drive shaft 24 will extend transversely over one of the gunwales 16 of the canoe 12.

A paddle assembly 26 is transversely connected to an outer end of the drive shaft 24. An apparatus 28 is for manually rotating an inner end of the drive shaft 24 by the person sitting on the seat 18 in the canoe 12. The paddle assembly 26 will contact water 30 thereabout to propel and steer the canoe 12 through the water 30.

The rotatively securing structure 25 includes a bracket 32 to transversely extend and engage with the seat 18 and the thwart 20 adjacent the gunwale 16 of the canoe 12. A drive shaft 34 is bearing on the bracket 32 to receive the drive shaft 24, so that the drive shaft 24 can rotate within the drive shaft bearing 34.

The paddle assembly 26 consists of an arm 36 transversely connected to the outer end of the drive shaft 24. A pair of blades 38, are provided with each located at an opposite end of the arm 36. The manually rotating apparatus 28 is a crank assembly 40 connected to the inner end of the drive shaft 24 in the bearing 34 on the bracket 32.

The bracket 32 is adjustable and includes a central tube 42 in which the drive shaft bearing 34 is transversely formed onto. A pair of main tubes 44 are provided, in which each main tube 44 extends out from one end of the central tube 42. A pair of sliding tubes 46 are provided, in which each sliding tube 46 fits into and adjustably extends out from one end of one main tube 44. A pair of L-shaped connector clamps 48 are also provided in which each long leg 50 of each connector clamp 48 is attached to a distal end of each sliding tube 46. Each short leg 52 of the connector clamps 48 will engage with the seat 18 and the thwart 20 of the canoe 12.

The arm 36 is adjustable and consists of a main hollow rod 54 transversely connected to the outer end of the drive shaft 24. A pair of extension rods 56 are provided, in which each extension rod 56 is connected at a first end to one of the blades 38, while a second end fits into and extends out from one end of the main hollow rod 54. A plurality of fasteners 58 are for securing the second end of each extension rod 56 to the main hollow rod 54 in a stationary position.

Each blade 38 is fabricated out of a thin flat plate 58 bent at a right angle at each opposite side 60, to form a generally U-shaped configuration. The plates 58 are each connected to the first end of each extension rod 56, so that the bent sides 60 will face in the same direction to contact the water 30.

The crank arm 62 is connected at a first end to the inner end of the drive shaft 24. A handle unit 64 extends at a right angle from a second end of the crank arm 62, which can be manually rotated by the person sitting on the seat 18 in the canoe 12, so as to turn the drive shaft 24. The handle unit 64 consists of a shank 66 pivotally connected to the second end of the crank arm 62. A hand grip 68 fits over the shank 66, so that a hand of the person can hold onto the hand grip 68 to operate the crank arm 62.

The central tube 42, the main tubes 44 and the sliding tubes 46 of the bracket 32, are all square in cross section. The main hollow rod 54 and the extension rod 56 of the arm 36 are circular in cross section. The drive shaft 24, the bracket 32, the drive shaft bearing 34, the paddle assembly 36 and the crank assembly 40, are all fabricated out of a durable non-corrosive material. Typically, but not limited to, stainless steel, plastic, wood and similar articles.

To use the manually operated propulsion device 10 a person attaches each propelling mechanism 22 to the canoe 12 as state above. The person can now sit upon the seat 18 and operate the propelling mechanism 22 together with each hand to propel the cane 12 through the water 30. If the person wants to turn the canoe 12 either to the left or the right, one of the propelling mechanisms 22 will be operated, while the other is kept inoperative, so as to steer the canoe 12.

LIST OF REFERENCE NUMBERS

10 manually operated propulsion device
12 canoe
14 hull of 12
16 gunwale of 12
18 seat in 12
20 thwart in 12
22 propelling mechanism
24 drive shaft
25 rotatively securing structure
26 paddle assembly
28 manually rotating apparatus
30 water
32 bracket of 25
34 drive shaft bearing of 25
36 arm of 26
38 blade of 26
40 crank assembly for 28
42 central tube of 32
44 main tube of 32
46 sliding tube of 32
48 L-shaped connector clamp of 32
50 long leg of 48
52 short leg of 48
54 main hollow rod of 36
56 extension rod of 36
58 thin flat plate for 38
60 bent side of 58
62 crank arm of 40
64 handle unit of 40
66 shank of 64
68 hand grip of 64

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A manually operated propulsion device for a canoe having a hull with a pair of gunwales, a seat extending directly under the gunwales for a person to operate said device and a thwart spaced away from the seat, extending directly under the gunwales, said device being two propelling mechanisms in which each of said propelling mechanism comprises:

a) a drive shaft;

b) means for rotatively securing said drive shaft between the seat and the thwart of the canoe, so that said drive shaft will extend transversely over one of the gunwales of the canoe; said securing means including a bracket to transversely extend and engage with the seat and the thwart adjacent the gunwale of the canoe; and a drive shaft bearing on said bracket to receive said drive shaft, so that said drive shaft can rotate within said drive shaft bearing;

c) a paddle assembly transversely connected to an outer end of said drive shaft; and d) means for manually rotating an inner end of said drive shaft by the person sitting on the seat in the canoe, so that said paddle assembly will contact water thereabout to propel and steer the canoe through the water.

2. A manually operated propulsion device for a canoe, as recited in claim 1, wherein said paddle assembly includes:

a) an arm transversely connected to the outer end of said drive shaft; and b) a pair of blades, each located at an opposite end of said arm.

3. A manually operated propulsion device for a canoe, as recited in claim 2, wherein said manually rotating means is a crank assembly connected to the inner end of said drive shaft in said bearing on said bracket.

4. A manually operated propulsion device for a canoe, as recited in claim 2, wherein said bracket is adjustable and includes:

a) a central tube in which said drive shaft bearing is transversely formed onto;

b) a pair of main tubes, in which each said main tube extends out from one end of said central tube;

c) a pair of sliding tubes, in which each said sliding tube fits into and adjustable extends out from one end of one said main tube; and d) a pair of L-shaped connector clamps in which each long leg of each said connector clamp is attached to a distal end of each said sliding tube, so that each short leg of said connector clamps will engage with the seat and the thwart of the canoe.

5. A manually operated propulsion device for a canoe, as recited in claim 4, wherein said bracket is adjustable and includes:

a) a main hollow rod transversely connected to the outer end of said drive shaft;

b) a pair of extension rods in which each said extension rod is connected at a first end to one of said blades, while a second end fits into and extends out from one end of said main hollow rod; and c) a plurality of fasteners for securing the second end of each said extension rod to said main hollow rod in a stationary position.

6. A manually operated propulsion device for a canoe, as recited in claim 5, wherein each said blade is fabricated out of a thin flat plate bent at a right angle at each opposite side to form a generally U-shaped configuration, whereby said plates are each connected to the first end of each said extension rod, so that the bent sides will face in the same direction to contact the water.

7. A manually operated propulsion device for a canoe, as recited in claim 6, wherein said crank assembly includes:

a) a crank arm connected at first end to the inner end of said drive shaft; and b) a handle unit extending at a right angle from a second end of said crank arm, which can be manually rotated by the person sitting on the seat in the canoe, so as to turn said drive shaft.

8. A manually operated propulsion device for a canoe, as recited in claim 7, wherein said handle unit includes:

a) a shank pivotally connected to the second end of said crank arm; and b) a hand grip to fit over said shank, so that a hand of the person can hold onto said hand grip to operate said crank arm.

9. A manually operated propulsion device for a canoe, as recited in claim 8, wherein said central tube, said main tubes and said sliding tubes of said bracket are all square in cross section.

10. A manually operated propulsion device for a canoe, as recited in claim 9, wherein said main hollow rod and said extension rods of said arm are circular in cross section.

11. A manually operated propulsion device for a canoe as recited in claim 10, wherein said drive shaft is fabricated out of a durable non-corrosive material.

12. A manually operated propulsion device for a canoe as recited in claim 11, wherein said bracket and said drive shaft bearing are fabricated out of a durable non-corrosive material.

13. A manually operated propulsion device for a canoe as recited in claim 12, wherein said paddle assembly is fabricated out of a durable non-corrosive material.

14. A manually operated propulsion device for a canoe as recited in claim 13, wherein said crank assembly is fabricated out of a durable non-corrosive material.

* * * * *